US006643885B2

(12) United States Patent
Morad et al.

(10) Patent No.: US 6,643,885 B2
(45) Date of Patent: Nov. 11, 2003

(54) METHOD OF MOLDING A PLASTIC BRACE INTO A SPONGE MOP HEAD AND APPARATUS FOR RETAINING A SPONGE MOP HEAD WITHIN A PLASTIC BRACE

(75) Inventors: Fred I. Morad, Toluca Lake, CA (US); James G. Horian, Newport Beach, CA (US)

(73) Assignee: Worldwide Integrated Resources, Inc., Commerce, CA (US)

( * ) Notice: Subject to any disclaimer, the term of this patent is extended or adjusted under 35 U.S.C. 154(b) by 457 days.

(21) Appl. No.: 09/795,262

(22) Filed: Feb. 27, 2001

(65) Prior Publication Data

US 2002/0116777 A1 Aug. 29, 2002

(51) Int. Cl.[7] ..... A47L 13/144
(52) U.S. Cl. ..... 15/119.2; 264/259; 264/274
(58) Field of Search ..... 15/119.1, 119.2, 15/244.1, 244.2; 264/259, 274

(56) References Cited

U.S. PATENT DOCUMENTS 4,908,901 A * 3/1990 Torres ..... 15/119.1
5,331,706 A * 7/1994 Graham ..... 15/119.2
6,490,749 B1 * 12/2002 Morad ..... 15/145

* cited by examiner

*Primary Examiner*—Terrence R. Till
(74) *Attorney, Agent, or Firm*—Thomas I. Rozsa; Tony D. Chen

(57) ABSTRACT

A method of molding a plastic brace into a sponge mop head and an apparatus for retaining a sponge mop head within a plastic brace. The method and apparatus includes a sponge assembly for use with wringer-type mops which include a sponge mop head firmly held by a plastic brace thereto. The brace is provided with a plurality of stitching members for retaining the sponge mop head within the plastic brace. The brace has an attachment member for operative attachment in a simple manner to the wringer-type sponge mop.

38 Claims, 7 Drawing Sheets

METHOD OF MOLDING A PLASTIC BRACE INTO A SPONGE MOP HEAD AND APPARATUS FOR RETAINING A SPONGE MOP HEAD WITHIN A PLASTIC BRACE

BACKGROUND OF THE INVENTION

1. Field of the Invention

The present invention relates generally to the field of sponge mops. More particularly, the present invention relates to a method of molding a plastic brace into a sponge mop head, and apparatus for retaining a sponge mop head within a plastic brace.

2. Description of the Prior Art

Specifically, wringer-type sponge mops are in wide use and well known in the art. These prior art sponge mops include a sponge retainer or carrier and operate so that the sponge head is movable between a cleaning position and a wringing position. In the wringing position, the sponge head may be subjected to squeezing pressure by opposing rollers which wring the water from the sponge head. In order that the sponge head may be replaced from time to time in wringer-type sponge mops, the sponge itself is retained in a rigid, usually metal, sponge carrier which is removably and slidably attached into two opposing retaining rails of the sponge mop. One disadvantage with prior art sponge mops is that the replaceable sponge heads are very difficult to replace from the sponge mop, thereby frustrating the user. Another disadvantage with prior art sponge mops is that the replaceable sponge heads are manufactured with a metal sponge retainer which holds the sponge and this system is not user friendly. In addition, the metal sponge retainer needs to be plated and the plating process causes pollution. A further disadvantage with prior art sponge mops is that the replaceable sponge heads are not replaceable in a user friendly manner.

It is highly desirable to have a very efficient and also very effective design and construction of a plastic brace for retaining a sponge mop head or the like. It is desirable to provide a method of molding a plastic brace into a sponge mop head or the like to provide optimum retaining means for retaining the sponge mop head. It is also desirable to provide a plastic brace with the capability of retaining a sponge mop head to be used with a conventional wringer-type sponge mop.

SUMMARY OF THE INVENTION

The present invention is a novel and unique method of molding a plastic brace or carrier means into a sponge mop head and an apparatus for retaining a sponge mop head within a plastic brace or carrier means.

The present invention provides a sponge assembly for use with wringer-type sponge mops which include a sponge mop head firmly held by a plastic brace. The plastic brace is provided with a plurality of stitching means for piercing and securing the sponge mop head within the plastic brace. The plastic brace is also provided with an attachment means for operative attachment in a simple manner to the wringer-type sponge mop. The plastic brace can be adapted for use with a variety of mop constructions and provides a sponge mop head which is particularly advantageous for use as a replacement sponge assembly.

It is an object of the present invention to provide a sponge assembly which includes a plastic brace for retaining a sponge mop head and to be used with a wringer-type sponge mop.

It is also an object of the present invention to provide a method of molding a plastic brace into a sponge mop head for forming a sponge assembly to be used in a wringer-type sponge mop.

It is an additional object of the present invention to provide a sponge assembly which includes a plastic brace which is adapted for use with a variety of wringer-type sponge mops.

It is a further object of the present invention to provide a sponge assembly which includes a plastic brace which is adapted for ready attachment to wringer-type sponge mops.

It is still an object of the present invention to provide a replacement sponge assembly which can be readily and simply attached by the users to wringer-type sponge mops of various constructions.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is a method of molding a plastic brace or carrier means into a sponge mop head and an apparatus for retaining a sponge mop head within a plastic brace or carrier means. In a preferred embodiment of the present invention, the plastic brace has two longitudinal grooves 50 formed on the exterior surface of the sidewalls and located below a plurality of stitching members 46 (see FIGS. 4 and 6). In an alternative embodiment of the present invention, the plastic brace has two longitudinal grooves 150 formed on the exterior surface of the sidewalls and located above a plurality of compression studs 148 (see FIG. 11).

Figure 1:
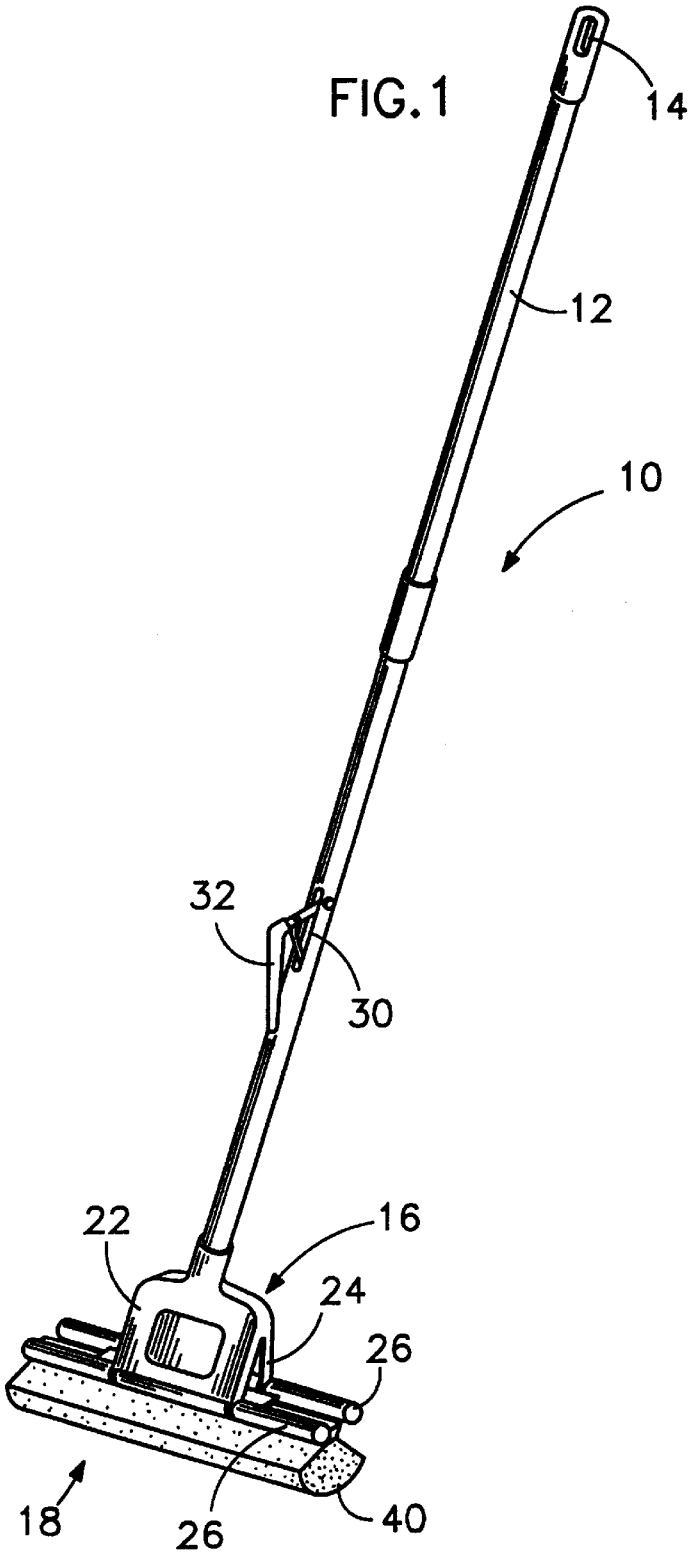
FIG. 1 is a perspective view of a conventional wringer-type sponge mop with the present invention sponge assembly installed thereto.
Figure 2:
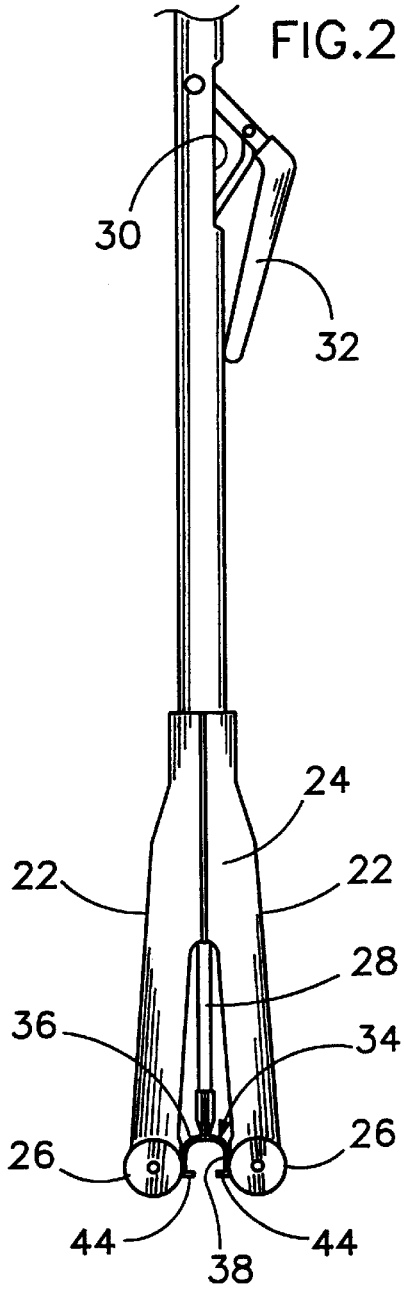
FIG. 2 is an enlarged side elevational view of the wringer-type sponge mop shown in FIG. 1, without the sponge assembly.

Referring to FIGS. 1 and 2, there is shown at 10 a wringer-type sponge mop which includes a longitudinal elongated handle 12 and a replaceable cleaning sponge assembly 18. The elongated handle 12 is in the form of a hollow tube with a suitable closure member 14 fixed at one end which may include an opening for hanging the mop 10 on a nail or a hook attached to a wall or any other suitable means. A cleaning head support housing 16 is fixed on the other end of the handle 12 for retaining the cleaning sponge assembly 18. The cleaning head support housing 16 is formed of two spaced apart halves of stamped sheet metal. The support housing 16 has generally flat front and rear walls 22 and end walls 24. The end walls 24 are bifurcated to provide support legs for a pair of roller support shafts on which a pair of opposing rollers 26 are supported thereto. The opposing rollers 26 extend in parallel spaced apart relation and receive the sponge assembly therebetween.

An operating rod 28 extends upwardly through the elongated handle 12 and has an upper end bent outwardly at an angle through a slot 30 approximately along a middle portion of the elongated handle 12. An operating lever 32 is pivotally connected at its inner end to the elongated handle 12. The upper end of the operating rod 28 is pivotally connected to the operating lever 32. The operating lever 32 can impart longitudinal inward and outward movement to the operating rod 28. Thus, the position of the cleaning sponge assembly 18 is controlled by the movement of the operating lever 32. When the operating lever 32 is moved upwardly, the cleaning sponge assembly 18 is drawn inwardly between the opposing rollers 26 so that any liquid in a cleaning sponge 40 is squeezed therefrom. When the operating lever 32 is moved back, the cleaning sponge 40 is moved outwardly between the pair of opposing rollers 26 to the cleaning position. When the operating lever 32 is moved downwardly, the cleaning sponge 40 is moved beyond the opposing rollers 26 to a position which facilitates the removal or replacement of the cleaning sponge assembly 18.

Figure 3:
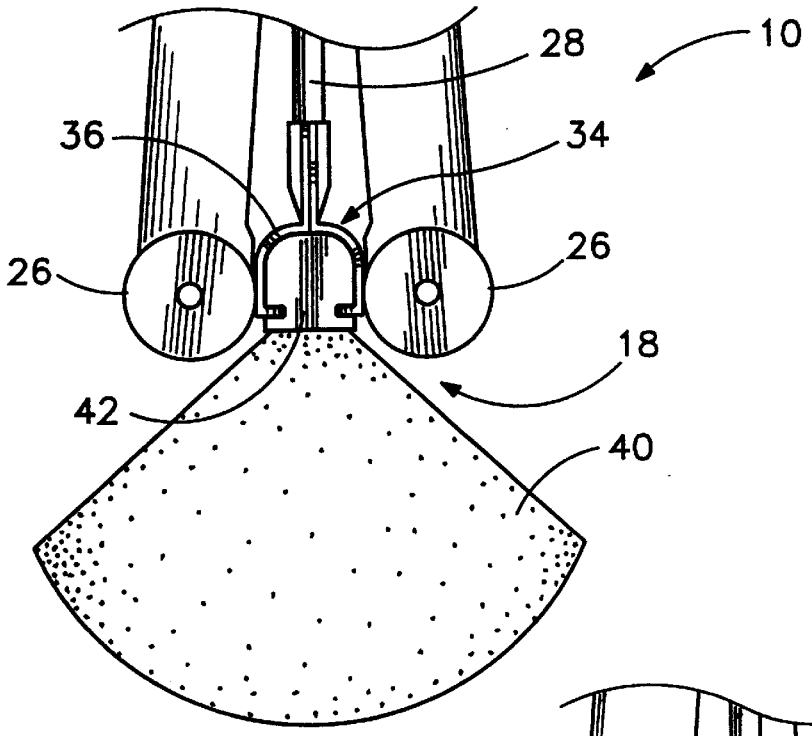
FIG. 3 is an enlarged partial side elevational view of the wringer-type sponge mop shown in FIG. 1, with the sponge assembly installed.

Referring to FIGS. 2 and 3, the operating rod 28 is attached to a transverse retaining means 34 which holds and secures the sponge assembly 18 thereto (see FIG. 3). By means of operating rod 28, the sponge assembly 18 can be retracted upwardly so that sponge 40 is squeezed between rollers 26 and moved downwardly to an extended position so that the sponge 40 is in its cleaning position. The retaining means 34 with a generally upside down U-shaped cross-section includes a horizontal downwardly arch top wall 36, two vertical parallel sidewalls 38 which extend down from the top wall 36, and two horizontal guide rails 44 which extend inwardly from the sidewalls 38 to form a passageway for receiving the sponge assembly 18.

It will be appreciated that the U-shaped cross-section of the retaining means 34 is not limited to the shape shown. It is emphasized that while the upside down U-shaped cross-section is the preferred, it is also within the spirit and scope of the present invention to utilize many different shapes, for example, a Y-shape or other suitable shapes not shown.

Referring to FIGS. 4 through 7, the sponge assembly 18 includes the sponge 40 which can be of a suitable absorbent resilient material, such as a regenerated cellulose sponge, and a brace member 42 which may be made out of plastic material. The plastic brace member 42 includes a top wall 43, two opposing sidewalls 45 and two opposing end walls 47. The sidewalls 45 and end walls 47 extend downwardly from the top wall 43 to form a hollow for receiving a portion of the sponge 40 therein. There are provided a plurality of spaced apart opposing compression studs 48 which are integrally formed on the interior surface of the sidewalls 45 of the sponge brace 42 and extend inwardly for compressing and securing the portion of the sponge 40 within the hollow of the plastic brace 42. Therefore, the portion of the sponge 40 is between the plurality of opposing compression studs 48 (see FIGS. 5 and 6). There are also provided a plurality of two adjacent stitching members 46 which are integrally formed with the interior surface of the sidewalls 45 of the plastic brace 42 for piercing and securing the portion of the sponge 40. These stitching members 46 are generally rectangular shape in the lengthwise direction. These plurality of two adjacent stitching members 46 extend across the width of the hollow of the plastic brace 42. Each of two adjacent stitching members 46 are respectively formed with the interior surface of the sidewalls of the plastic brace 42. The shape of the piercing tip of the stitching members may be a square tip, a round tip, a U-shaped tip, a tapered tip, an oval tip or any other suitable shaped tips. The plastic brace 42 further has two longitudinal grooves 50 formed on the exterior surface of the sidewalls 45. A boss 52 is integrally formed on one of the longitudinal grooves 50 for preventing the sponge assembly 18 from sliding out on its own from the retaining means 34 of the sponge mop 10.

The plastic brace 42 can be molded of a plastic material and can be of any suitable length so as to be useful with a variety of mop sizes. The manufacturing process which could accommodate the construction of the sponge brace may be insert molding, injection, thermoform, etc. or other molding process. Typically, for use as a replacement sponge assembly, the plastic brace 42 may have a length of approximately 8 to 12 inches to fit the most common wringer-type sponge mops.

From the foregoing description it is apparent that the disclosed sponge assembly is readily adaptable for use as a replacement for sponge roller mops. This affords flexibility and convenience to users in the replacement of sponges.

Figure 4:
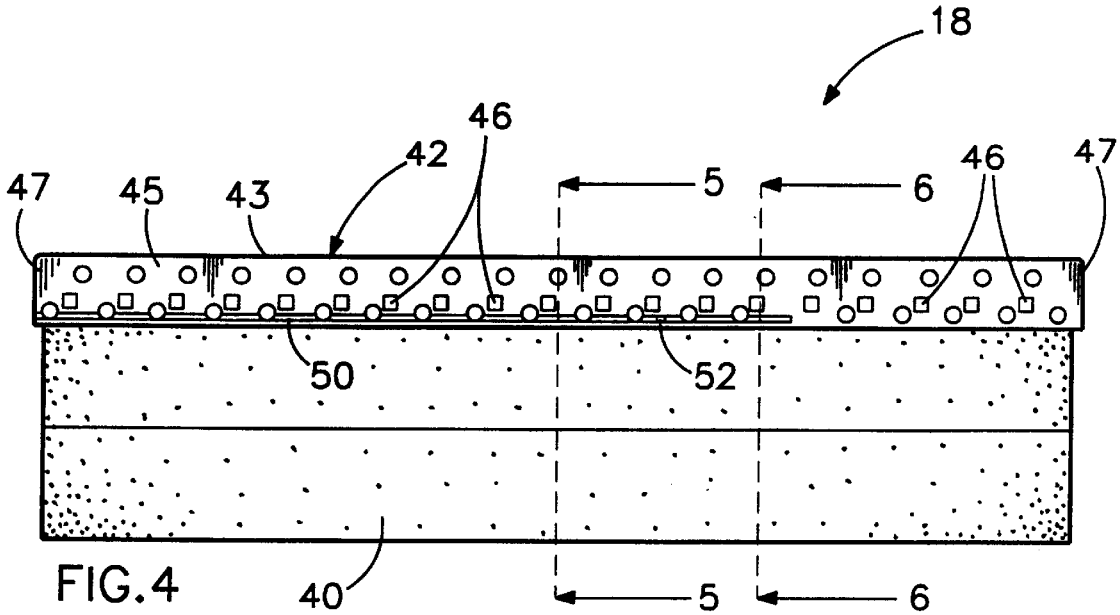
FIG. 4 is a side elevational view of the present invention sponge assembly for use with a wringer-type sponge mop.
Figure 5:
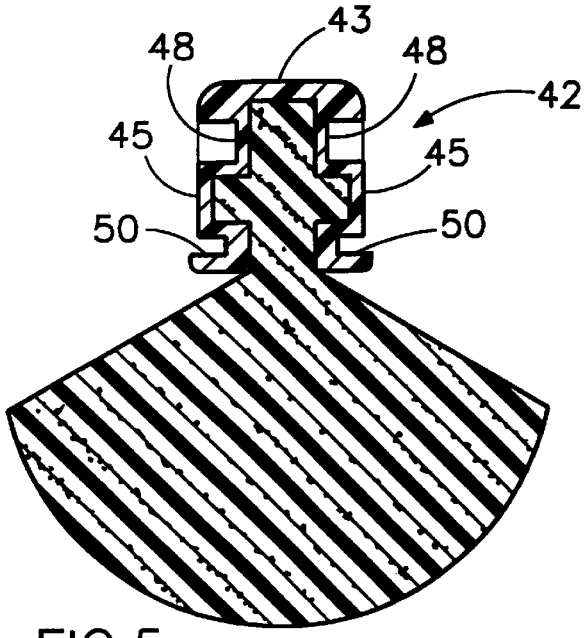
FIG. 5 is a cross-sectional view taken along line 5—5 of FIG. 4.
Figure 6:
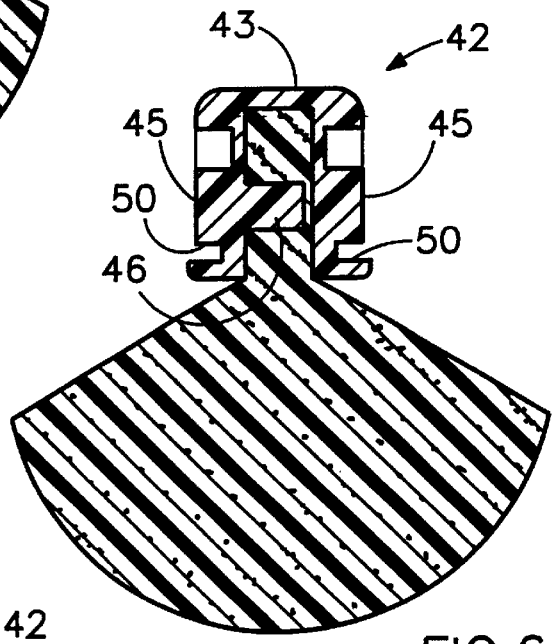
FIG. 6 is a cross-sectional view taken along line 6—6 of FIG. 4.
Figure 7:
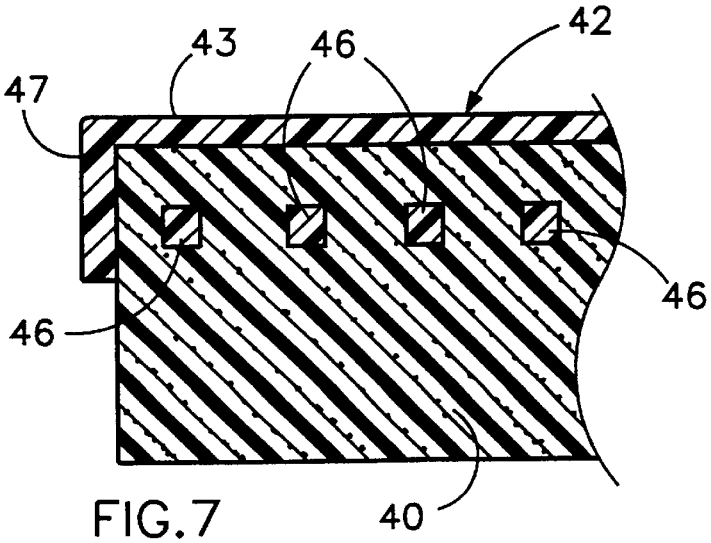
FIG. 7 is a longitudinal cross-sectional view of the present invention sponge assembly.
Figure 8:
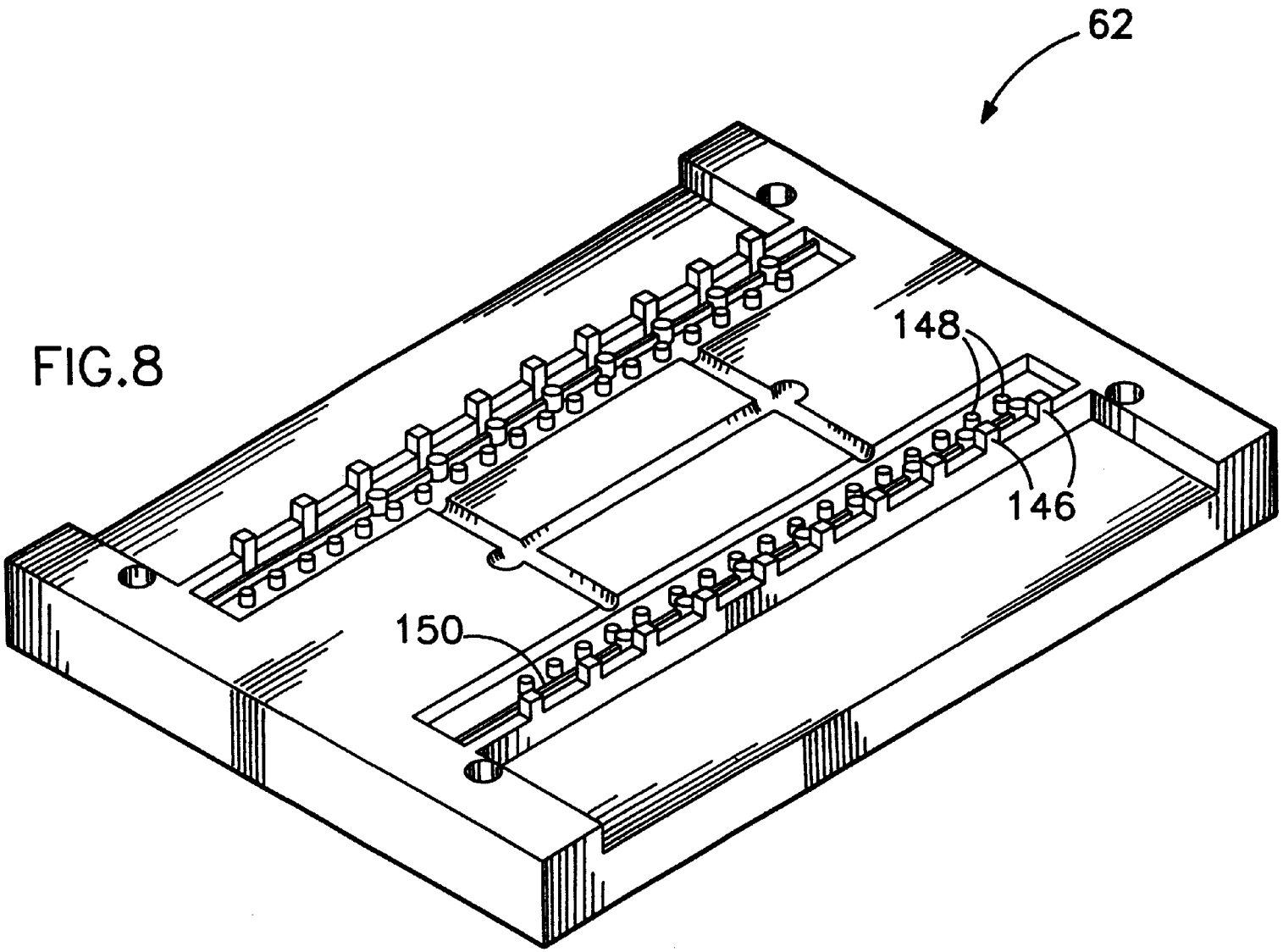
FIG. 8 is a perspective view of a preferred embodiment of a bottom mold half of the present invention method of molding a plastic brace into a sponge mop head.
Figure 9:
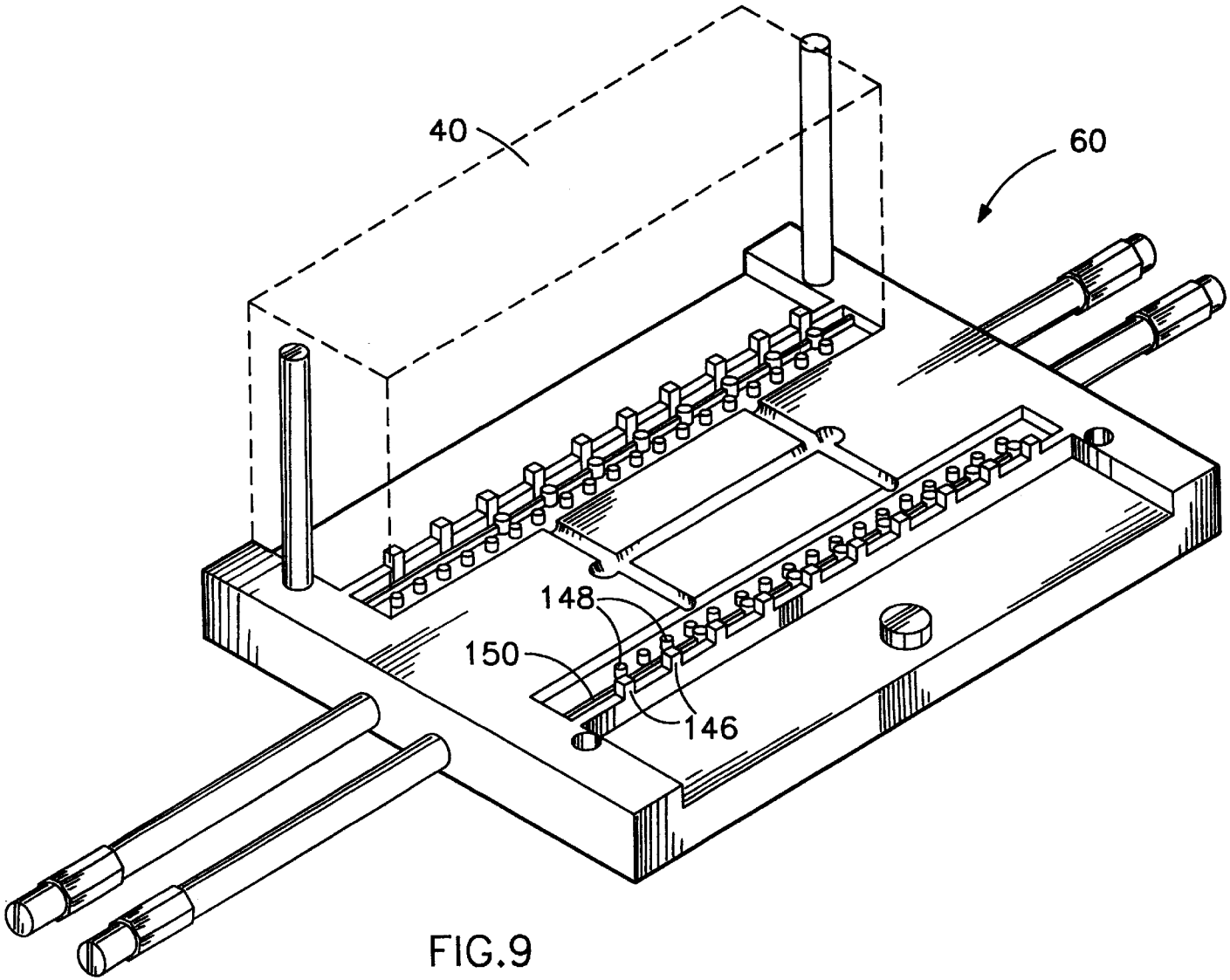
FIG. 9 is a perspective view of a preferred embodiment of the top mold half of the present invention method of molding a plastic brace into a sponge mop head, showing one of the sponge mop heads in position.

Referring to FIGS. 8 and 9, there is shown a method of molding a plastic sponge brace 42 into a cleaning sponge mop head 40 (see FIGS. 4, 5 and 6). FIG. 8 depicts a bottom or first mold half 62 for molding one half of the plastic sponge brace 42. FIG. 9 depicts a top or second mold half 60 for molding the other half of the plastic sponge brace 42. These mold halves 60 and 62 can form two plastic braces 42 into two cleaning sponge heads 40 (only one is shown in dashed lines).

Referring to FIG. 8, there is shown the first mold half 62 which includes a plurality of spaced apart needles 146 which form the stitching members of the plastic sponge brace 42, a plurality of spaced apart towers 148 which form the compression studs 48 of the plastic brace 42, and a protruding rail 150 which form the longitudinal groove 50 of the plastic brace 42. Referring to FIG. 9, there is depicted a cleaning sponge 40 positioned on one side of the top mold half 60 so that the bottom mold half 62 (see FIG. 8) can be positioned against the top mold half 60 such that the sponge 40 is squeezed therebetween. The top mold half 60 has the same components as the bottom mold half 62 except that the plurality of needles 146 are off-set from one another to form two adjacent stitching members 46 as discussed above.

Figure 10:
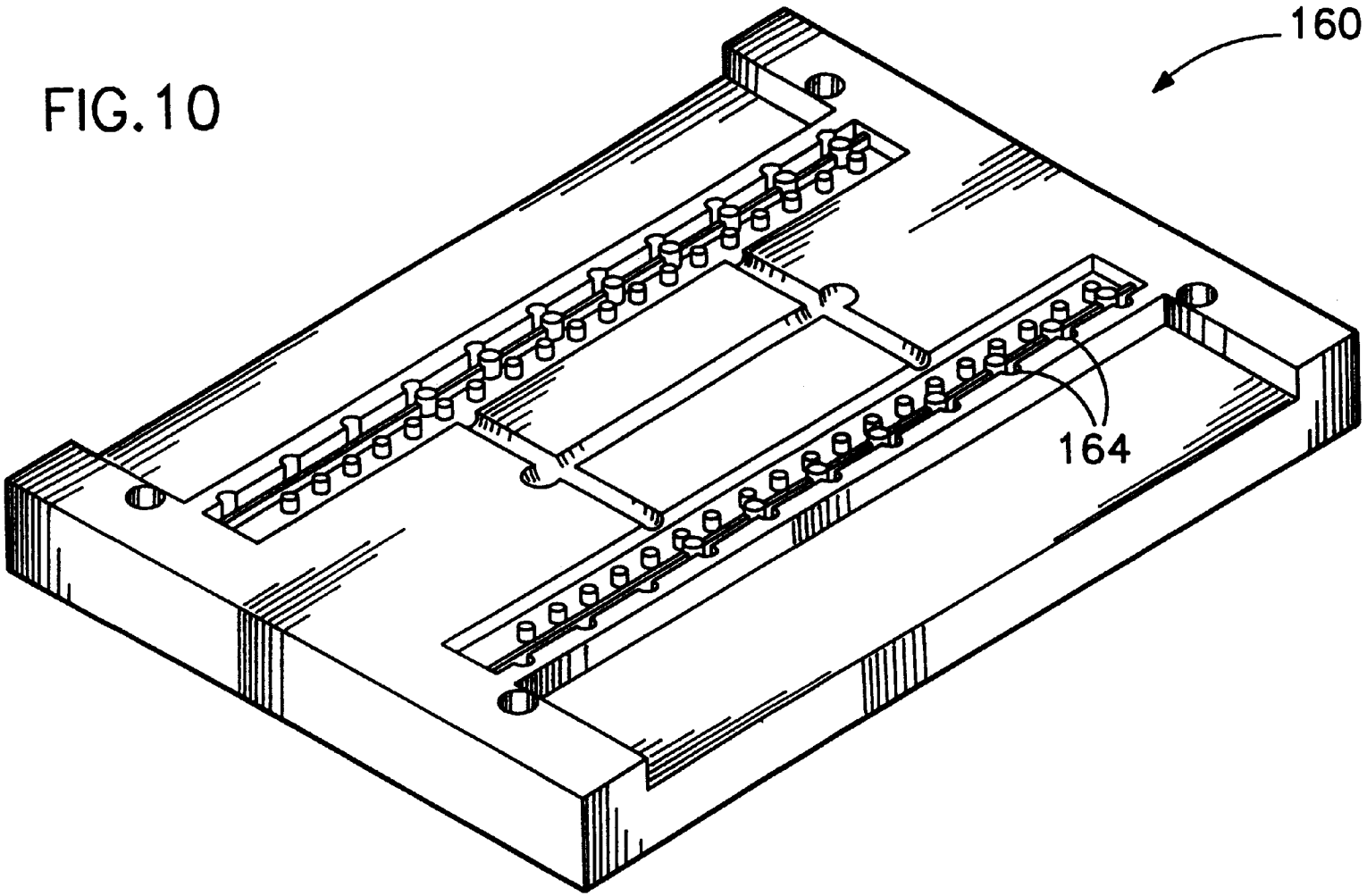
FIG. 10 is a perspective view of an alternative embodiment of the bottom mold half of the present invention method of molding a plastic brace into a sponge mop head.

Referring to FIG. 10, there is shown a bottom or first mold half 162 which is an alternative embodiment of the mold half 62 shown in FIG. 8. In this embodiment, the mold half 162 has a plurality of spaced apart half cavities 164 which replace the needles 146 of the mold half 60. These half cavities 164 are aligned with the plurality of needles 146 of the mold half 60.

Referring to FIGS. 8 and 9, there is shown a method of molding a plastic sponge brace 42 into a cleaning sponge mop head 40 (see FIG. 3). FIG. 8 depicts a top or first mold half 62 for molding one half of the plastic sponge brace 42. FIG. 9 depicts a top or second mold half 60 for molding the other half of the plastic sponge brace 42. These mold halves 60 and 62 can form two plastic sponge braces 42 into two cleaning sponge heads 40.

The method comprises the steps of first making or creating the top mold 62 and the bottom mold 60 as discussed above. The second step is to provide a generally rectangular shaped cleaning sponge head 40 (shown as dashed lines in FIG. 9) and position it as shown in FIG. 9 (only one sponge head is shown but two sponge heads can be positioned on the mold half 60). The third step is to install the other mold half 62 onto the mold half 60 and squeeze a portion of the sponge head 40 therebetween. The fourth step is to inject hot molten plastic into the top and bottom mold halves. The fifth step is to allow the injected hot molten plastic to cool to form the unitary plastic brace having a top wall, two opposing sidewalls and two opposing end walls, the sidewalls and end walls extending downwardly from the top wall to form a hollow adapted to receive a portion of the sponge head. The sixth step is to integrally mold a plurality of first spaced apart compression studs to the interior surface of one of the two opposing sidewalls of the unitary plastic brace. The seventh step is to integrally mold a plurality of second spaced apart compression studs to the interior of the other one of the two opposing sidewalls. The plurality of second compression studs are respectively aligned with the plurality of first compression studs for compressing the portion of the sponge head within the hollow. The eighth step is to integrally mold a plurality of first stitching members to a bottom edge of one of the two opposing sidewalls and extend across to an opposite sidewall for piercing and retaining the portion of the sponge head within the hollow. The ninth step is to integrally mold a plurality of second stitching members to a bottom edge of the other one of the two opposing sidewalls and extend across to an opposite sidewall and respectively located adjacent to the plurality of first stitching members for piercing and retaining the portion of the sponge head within the hollow. The tenth step is to integrally form a pair of elongated grooves on the exterior surfaces of the sidewalls for respectively receiving a pair of opposite retaining rails of the sponge mop to hold the sponge assembly in assembled relationship with the sponge mop. The eleventh step is to provide a boss located on one of the pair of grooves for preventing the sponge assembly from sliding out of the retaining rails of the sponge mop.

Figure 12:
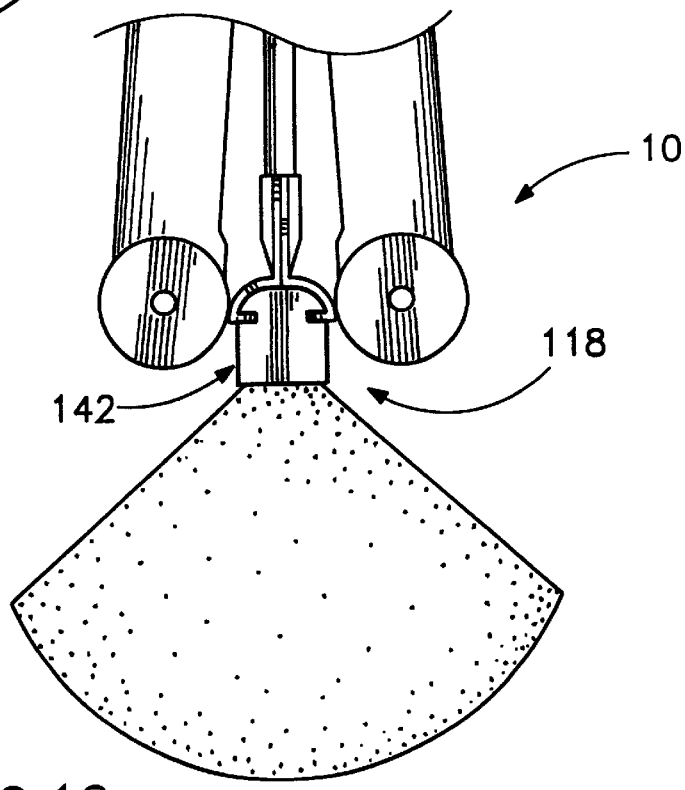
FIG. 12 is an enlarged partial side elevational view of the wringer-type sponge mop, with the sponge assembly shown in FIG. 11 installed.
Figure 11:
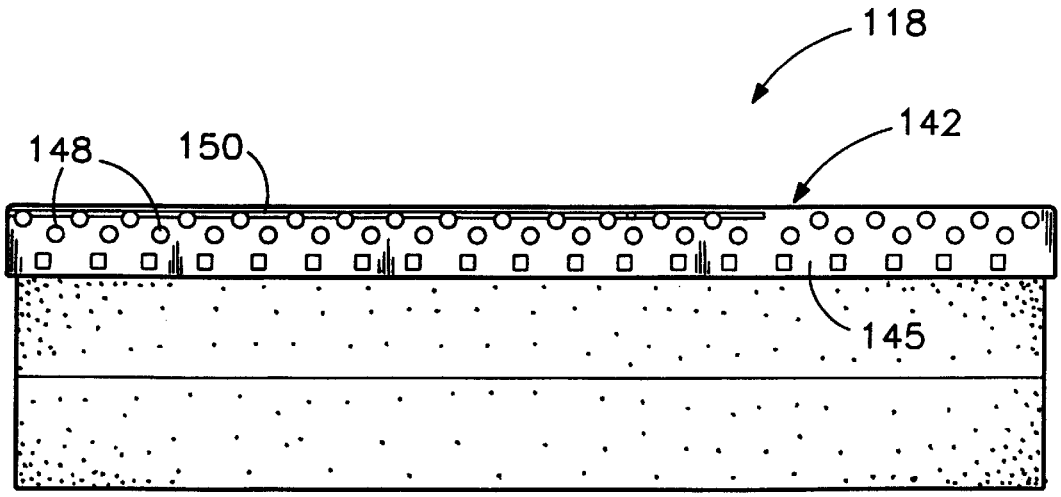
FIG. 11 is a side elevational view of an alternative embodiment of the present invention sponge assembly for use with a wringer-type sponge mop.

Referring to FIGS. 11 and 12, there is shown an alternative embodiment of the present invention method of molding a plastic brace or carrier means into a sponge mop head and an apparatus for retaining a sponge mop head within a plastic brace or carrier means. The alternative embodiment of the present invention is very similar to the preferred embodiment just discussed and the only difference is the location of the two longitudinal grooves 150. All of the parts of this embodiment are numbered correspondingly with 100 added to each number. In this alternative embodiment, the plastic brace 142 has two longitudinal grooves 150 formed on the exterior surface of the sidewalls 145 and located above the plurality of compression studs 148. Therefore, the sponge assembly 118 is installed to the sponge mop 10 as shown in FIG. 12. Since the sponge assembly 118 assembles and functions the same as previously described in the preceding embodiment, the description thereof will not be repeated.

Defined in detail, the present invention is a sponge assembly for use with a wringer-type sponge mop, comprising: (a) a cleaning sponge head; (b) an elongated unitary plastic brace having a top wall, two opposing sidewalls and two opposing end walls, the sidewalls and end walls extending downwardly from the top wall to form a hollow adapted to receive a portion of the sponge head; (c) a plurality of first spaced apart compression studs integrally molded to the interior surface of one of the two opposing sidewalls; (d) a plurality of second spaced apart compression studs integrally molded to the interior of the other one of the two opposing sidewalls, the plurality of second compression studs respectively aligned with the plurality of first compression studs for compressing the portion of the sponge head within the hollow; (e) a plurality of first stitching members integrally molded to one of the two opposing sidewalls and extending across to an opposite sidewall for piercing and retaining the portion of the sponge head within the hollow; (f) a plurality of second stitching members integrally molded to the other one of the two opposing sidewalls and extending across to an opposite sidewall and respectively located adjacent to the plurality of first stitching members for piercing and retaining the portion of the sponge head within the hollow; (g) a pair of elongated grooves integrally formed on the exterior surfaces of the sidewalls for respectively receiving a pair of opposite retaining rails of the sponge mop to hold the sponge assembly in assembled relationship with the sponge mop; and (h) a boss located on one of the pair of grooves for preventing the sponge assembly from sliding out of the retaining rails of the sponge mop.

Defined broadly, the present invention is a sponge assembly for use with a wringer-type sponge mop, comprising: (a) a cleaning sponge head; (b) an elongated unitary brace having a top wall and two opposing sidewalls extending downwardly from the top wall to form a hollow adapted to receive a portion of the sponge head; (c) a plurality of first spaced apart compression studs integrally molded to the interior surface of one of the two opposing sidewalls; (d) a plurality of second spaced apart compression studs integrally molded to the interior of the other one of the two opposing sidewalls, the plurality of second compression studs respectively aligned with the plurality of first compression studs for compressing the portion of the sponge head within the hollow; (e) a plurality of first stitching members integrally molded to one of the two opposing sidewalls and extending across to an opposite sidewall for piercing and retaining the portion of the sponge head within the hollow; (f) a plurality of second stitching members integrally molded to the other one of the two opposing sidewalls and extending across to an opposite sidewall and respectively located adjacent to the plurality of first stitching members for piercing and retaining the portion of the sponge head within the hollow; (g) a pair of elongated grooves integrally formed on the exterior surfaces of the sidewalls for respectively receiving a pair of opposite retaining rails of the sponge mop to hold the sponge assembly in assembled relationship with the sponge mop; and (h) a boss located on one of the pair of grooves for preventing the sponge assembly from sliding out of the retaining rails of the sponge mop.

Defined more broadly, the present invention is a sponge assembly for use with a sponge mop, comprising: (a) a sponge; (b) a brace having a top wall and two sidewalls extending downwardly from the top wall to form a hollow adapted to receive a portion of the sponge; (c) a plurality of compression studs formed on the two sidewalls, a respective two compression studs oppositely aligned with each other for compressing the portion of the sponge within the hollow; (d) a plurality of stitching members formed on the sidewalls, a respective two stitching members located adjacent to each other for piercing and retaining the portion of the sponge within the hollow; (e) two grooves formed on the sidewalls for respectively receiving a pair of retaining rails of the sponge mop to hold the sponge assembly in assembled relationship with the sponge mop; and (f) means for preventing the sponge assembly from sliding out of the retaining rails of the sponge mop.

Defined even more broadly, the present invention is a sponge assembly for use with a sponge mop, comprising: (a) a sponge; (b) a brace having a hollow adapted to receive a portion of the sponge; (c) a plurality of compression studs formed on the interior of the brace for compressing the portion of the sponge within the hollow; (d) a plurality of stitching members formed on the interior of the brace for piercing and retaining the portion of the sponge within the hollow; and (e) at least one groove formed on the brace for receiving a retaining rail of the sponge mop to hold the sponge assembly in assembled relationship with the sponge mop.

Defined alternatively in detail, the present invention is a method of molding an elongated unitary brace into a sponge head to form a sponge assembly for use in a wringer-type sponge mop, the method comprising the steps of: (a) making a top mold half and a bottom mold half; (b) positioning the sponge head on the top mold half; (c) installing the bottom mold half onto the top mold half and squeezing a portion of the sponge head therebetween; (d) injecting hot molten plastic into the top and bottom mold halves; (e) cooling the injected hot molten plastic to form the unitary brace having a top wall and two opposing sidewalls extending downwardly from the top wall to form a hollow adapted to receive the portion of the sponge head; (f) integrally molding a plurality of first spaced apart compression studs to the interior surface of one of the two opposing sidewalls of the unitary brace; (g) integrally molding a plurality of second spaced apart compression studs to the interior of the other one of the two opposing sidewalls, the plurality of second compression studs respectively aligned with the plurality of first compression studs for compressing the portion of the sponge head within the hollow; (h) integrally molding a plurality of first stitching members to one of the two opposing sidewalls and extending across to an opposite sidewall for piercing and retaining the portion of the sponge head within the hollow; (i) integrally molding a plurality of second stitching members to the other one of the two opposing sidewalls and extending across to an opposite sidewall and respectively located adjacent to the plurality of first stitching members for piercing and retaining the portion of the sponge head within the hollow; (j) integrally forming a pair of elongated grooves on the exterior surfaces of the sidewalls for respectively receiving a pair of opposite retaining rails of the sponge mop to hold the sponge assembly in assembled relationship with the sponge mop; and (k) providing a boss located on one of the pair of grooves for preventing the sponge assembly from sliding out of the retaining rails of the sponge mop.

Defined alternatively broadly, the present invention is a method of molding a unitary plastic brace into a sponge head to form a sponge assembly for use in a wringer-type sponge mop, the method comprising the steps of: (a) making a mold; (b) positioning the sponge head on the mold; (c) injecting hot molten plastic into the mold; (d) cooling the injected molten plastic to form the unitary brace having a top wall and two sidewalls extending downwardly from the top wall to form a hollow adapted to receive a portion of the sponge head; (e) integrally forming a plurality of first compression studs to the interior surface of one of the two sidewalls; (f) integrally forming a plurality of second compression studs to the interior of the other one of the two sidewalls, the plurality of second compression studs respectively aligned with the plurality of first compression studs for compressing the portion of the sponge head within the hollow; (g) integrally forming a plurality of first stitching members to one of the two sidewalls and extending across to an opposite sidewall for piercing and retaining the portion of the sponge head within the hollow; (h) integrally forming a plurality of second stitching members to the other one of the two sidewalls and extending across to an opposite sidewall and respectively located adjacent to the plurality of first stitching members for piercing and retaining the portion of the sponge head within the hollow; (i) integrally forming at least two grooves on the exterior surface of the sidewalls for respectively receiving a pair of opposite retaining rails of the sponge mop to hold the sponge assembly in assembled relationship with the sponge mop; and (j) providing a boss located on one of the at least two grooves for preventing the sponge assembly from sliding out of the retaining rails of the sponge mop.

Defined alternatively more broadly, the present invention is a method of molding a brace into a sponge to form a sponge assembly for use in a sponge mop, the method comprising the steps of: (a) providing a mold; (b) positioning the sponge onto the mold; (c) pouring molten plastic into the mold; (d) forming the brace having a hollow adapted to receive a portion of the sponge; (e) forming a plurality of stitching members within the hollow for piercing and retaining the portion of the sponge within the hollow; (f) forming at least one groove on the brace for receiving at least one retaining rail of the sponge mop to hold the sponge assembly in assembled relationship with the sponge mop; and (g) preventing the sponge assembly from sliding out of the at least one retaining rail of the sponge mop.

Defined alternatively even more broadly, the present invention is a method of forming a brace into a sponge to form a sponge assembly for use in a sponge mop, the method comprising the steps of: (a) providing a mold; (b) positioning the sponge onto the mold; (c) pouring molten plastic into the mold; (d) forming the brace having a hollow adapted to receive a portion of the sponge; (e) forming a plurality of stitching members within the hollow for piercing and retaining the portion of the sponge within the hollow; and (f) forming means on the brace for receiving at least one retaining rail of the sponge mop to hold the sponge assembly in assembled relationship with the sponge mop.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A sponge assembly for use with a wringer-type sponge mop, comprising:

a. a cleaning sponge head;

b. an elongated unitary plastic brace having a top wall, two opposing sidewalls and two opposing end walls, the sidewalls and end walls extending downwardly from the top wall to form a hollow adapted to receive a portion of said sponge head;

c. a plurality of first spaced apart compression studs integrally molded to the interior surface of one of said two opposing sidewalls;

d. a plurality of second spaced apart compression studs integrally molded to the interior of the other one of said two opposing sidewalls, the plurality of second compression studs respectively aligned with said plurality of first compression studs for compressing said portion of said sponge head within said hollow;

e. a plurality of first stitching members integrally molded to one of said two opposing sidewalls and extending across to an opposite sidewall for piercing and retaining said portion of said sponge head within said hollow;

f. a plurality of second stitching members integrally molded to the other one of said two opposing sidewalls and extending across to an opposite sidewall and respectively located adjacent to said plurality of first stitching members for piercing and retaining said portion of said sponge head within said hollow;

g. a pair of elongated grooves integrally formed on the exterior surfaces of said sidewalls for respectively receiving a pair of opposite retaining rails of said sponge mop to hold said sponge assembly in assembled relationship with said sponge mop; and h. a boss located on one of said pair of grooves for preventing said sponge assembly from sliding out of said retaining rails of said sponge mop.

2. The sponge assembly in accordance with claim 1, wherein said pair of elongated grooves extend approximately three-quarters of a length of said unitary plastic brace.

3. The sponge assembly in accordance with claim 1, wherein said pair of elongated grooves are located above said plurality of first and second compression studs.

4. The sponge assembly in accordance with claim 1, wherein said pair of elongated grooves are located below said plurality of first and second stitching members.

5. The sponge assembly in accordance with claim 1, wherein said elongated unitary plastic brace is generally a rectangular shape.

6. A sponge assembly for use with a wringer-type sponge mop, comprising:

a. a cleaning sponge head;

b. an elongated unitary brace having a top wall and two opposing sidewalls extending downwardly from the top wall to form a hollow adapted to receive a portion of said sponge head;

c. a plurality of first spaced apart compression studs integrally molded to the interior surface of one of said two opposing sidewalls;

d. a plurality of second spaced apart compression studs integrally molded to the interior of the other one of said two opposing sidewalls, the plurality of second compression studs respectively aligned with said plurality of first compression studs for compressing said portion of said sponge head within said hollow;

e. a plurality of first stitching members integrally molded one of said two opposing sidewalls and extending across to an opposite sidewall for piercing and retaining said portion of said sponge head within said hollow;

f. a plurality of second stitching members integrally molded to the other one of said two opposing sidewalls and extending across to an opposite sidewall and respectively located adjacent to said plurality of first stitching members for piercing and retaining said portion of said sponge head within said hollow;

g. a pair of elongated grooves integrally formed on the exterior surfaces of said sidewalls for respectively receiving a pair of opposite retaining rails of said sponge mop to hold said sponge assembly in assembled relationship with said sponge mop; and h. a boss located on one of said pair of grooves for preventing said sponge assembly from sliding out of said retaining rails of said sponge mop.

7. The sponge assembly in accordance with claim 6, wherein said pair of elongated grooves extend approximately three-quarters of a length of said unitary plastic brace.

8. The sponge assembly in accordance with claim 6, wherein said pair of elongated grooves are located above said plurality of first and second compression studs.

9. The sponge assembly in accordance with claim 6, wherein said pair of elongated grooves are located below said plurality of first and second stitching members.

10. The sponge assembly in accordance with claim 6, wherein said elongated unitary brace is generally a rectangular shape.

11. The sponge assembly in accordance with claim 6, wherein said elongated unitary brace is made out of plastic material.

12. A sponge assembly for use with a sponge mop, comprising:

a. a sponge;

b. a brace having a top wall and two sidewalls extending downwardly from the top wall to form a hollow adapted to receive a portion of said sponge;

c. a plurality of compression studs formed on said two sidewalls, a respective two compress ion studs oppositely aligned with each other for compressing said portion of said sponge within said hollow;

d. a plurality of stitching members formed on said sidewalls, a respective two stitching members located adjacent to each other for piercing and retaining said portion of said sponge within said hollow;

e. two grooves formed on said sidewalls for respectively receiving a pair of retaining rails of said sponge mop to hold said sponge assembly in assembled relationship with said sponge mop; and f. means for preventing said sponge assembly from sliding out of said retaining rails of said sponge mop.

13. The sponge assembly in accordance with claim 12, wherein said two grooves extend approximately three-quarters of a length of said brace.

14. The sponge assembly in accordance with claim 12, wherein said two grooves are located above said plurality of compression studs.

15. The sponge assembly in accordance with claim 12, wherein said two grooves are located below said plurality of stitching members.

16. The sponge assembly in accordance with claim 12, wherein said brace is generally a rectangular shape.

17. The sponge assembly in accordance with claim 12, wherein said brace is made out of plastic material.

18. The sponge assembly in accordance with claim 12, wherein said means for preventing said brace from sliding out of said retaining rails of said sponge mop includes a boss located on one of said two grooves.

19. A sponge assembly for use with a sponge mop, comprising:

a. a sponge;

b. a brace having a hollow adapted to receive a portion of said sponge;

c. a plurality of compression studs formed on the interior of said brace for compressing said portion of said sponge within said hollow;

d. a plurality of stitching members formed on the interior of said brace for piercing and retaining said portion of said sponge within said hollow; and e. at least one groove formed on said brace for receiving a retaining rail of said sponge mop to hold said sponge assembly in assembled relationship with said sponge mop.

20. The sponge assembly in accordance with claim 19, wherein said at least one groove extends approximately three-quarters of a length of said brace.

21. The sponge assembly in accordance with claim 19, wherein said at least one groove is located above said plurality of compression studs.

22. The sponge assembly in accordance with claim 19, wherein said at least one groove is located below said plurality of stitching members.

23. The sponge assembly in accordance with claim 19, wherein said brace is generally a rectangular shape.

24. The sponge assembly in accordance with claim 19, wherein said brace is made out of plastic material.

25. The sponge assembly in accordance with claim 19, further comprising means for preventing said sponge assembly from sliding out of said retaining rail of said sponge mop.

26. The sponge assembly in accordance with claim 25, wherein said means for preventing said brace from sliding out of said retaining rail of said sponge mop includes a boss located on said at least one groove.

27. The sponge assembly in accordance with claim 19, further comprising a plurality of cavities located opposite of said plurality of stitching members for respectively receiving said plurality of stitching members thereto.

28. A method of molding an elongated unitary brace into a sponge head to form a sponge assembly for use in a wringer-type sponge mop, the method comprising the steps of:

a. making a top mold half and a bottom mold half;

b. positioning said sponge head on said top mold half;

c. installing said bottom mold half onto said top mold half and squeezing a portion of said sponge head therebetween;

d. injecting hot molten plastic into said top and bottom mold halves;

e. cooling said injected hot molten plastic to form said unitary brace having a top wall and two opposing sidewalls extending downwardly from the top wall to form a hollow adapted to receive said portion of said sponge head;

f. integrally molding a plurality of first spaced apart compression studs to the interior surface of one of the two opposing sidewalls of said unitary brace;

g. integrally molding a plurality of second spaced apart compression studs to the interior of the other one of the two opposing sidewalls, the plurality of second compression studs respectively aligned with said plurality of first compression studs for compressing said portion of said sponge head within said hollow;

h. integrally molding a plurality of first stitching members to one of said two opposing sidewalls and extending across to an opposite sidewall for piercing and retaining said portion of said sponge head within said hollow;

i. integrally molding a plurality of second stitching members to the other one of said two opposing sidewalls and extending across to an opposite sidewall and respectively located adjacent to the plurality of first stitching members for piercing and retaining said portion of said sponge head within said hollow;

j. integrally forming a pair of elongated grooves on the exterior surfaces of said sidewalls for respectively receiving a pair of opposite retaining rails of said sponge mop to hold said sponge assembly in assembled relationship with the sponge mop; and k. providing a boss located on one of said pair of grooves for preventing said sponge assembly from sliding out of said pair of retaining rails of said sponge mop.

29. The method in accordance with claim 28, further comprising the step of forming two opposing end walls which are integrally connected to said two opposing sidewalls and said top wall of said unitary brace.

30. A method of molding a unitary brace into a sponge head to form a sponge assembly for use in a wringer-type sponge mop, the method comprising the steps of:

a. making a mold;

b. positioning said sponge head on said mold;

c. injecting hot molten plastic into said mold;

d. cooling said injected molten plastic to form said unitary brace having a top wall and two sidewalls extending downwardly from the top wall to form a hollow adapted to receive a portion of said sponge head;

e. integrally forming a plurality of first compression studs to the interior surface of one of said two sidewalls;

f. integrally forming a plurality of second compression studs to the interior of the other one of said two sidewalls, the plurality of second compression studs respectively aligned with said plurality of first compression studs for compressing said portion of said sponge head within said hollow;

g. integrally forming a plurality of first stitching members to one of said two sidewalls and extending across to an opposite sidewall for piercing and retaining said portion of said sponge head within said hollow;

h. integrally forming a plurality of second stitching members to the other one of said two sidewalls and extending across to an opposite sidewall and respectively located adjacent to said plurality of first stitching members for piercing and retaining said portion of said sponge head within said hollow;

i. integrally forming at least two grooves on the exterior surface of said sidewalls for respectively receiving a pair of opposite retaining rails of said sponge mop to hold said sponge assembly in assembled relationship with said sponge mop; and j. providing a boss located on one of said at least two grooves for preventing said sponge assembly from sliding out of said retaining rails of said sponge mop.

31. The method in accordance with claim 30, further comprising the step of forming two end walls which are integrally connected to said two sidewalls and said top wall of said unitary brace.

32. A method of molding a brace into a sponge to form a sponge assembly for use in a sponge mop, the method comprising the steps of:

a. providing a mold;

b. positioning said sponge onto said mold;

c. pouring molten plastic into said mold;

d. forming said brace having a hollow adapted to receive a portion of said sponge;

e. forming a plurality of stitching members within said hollow for piercing and retaining said portion of said sponge within said hollow;

f. forming at least one groove on said brace for receiving at least one retaining rail of said sponge mop to hold said sponge assembly in assembled relationship with said sponge mop; and g. preventing said sponge assembly from sliding out of said at least one retaining rail of said sponge mop.

33. The method in accordance with claim 32, further comprising the step forming a plurality of stud members within said hollow for retaining said portion of said sponge within said hollow.

34. A method of forming a brace into a sponge to form a sponge assembly for use in a sponge mop, the method comprising the steps of:

a. providing a mold;

b. positioning said sponge onto said mold;

c. pouring molten plastic into said mold;

d. forming said brace having a hollow adapted to receive a portion of said sponge;

e. forming a plurality of stitching members within said hollow for piercing and retaining said portion of said sponge within said hollow; and f. forming means on said brace for receiving at least one retaining rail of said sponge mop to hold said sponge assembly in assembled relationship with said sponge mop.

35. The method in accordance with claim 34, further comprising the step of forming a plurality of compression stud members within said hollow for compressing said portion of said sponge within said hollow.

36. The method in accordance with claim 34, wherein said forming means includes at least one groove.

37. The method in accordance with claim 36, further comprising the step of forming a boss on said at least one groove for preventing said sponge assembly from sliding out of said retaining rail of said sponge mop.

38. The method in accordance with claim 34, further comprising the step of forming a plurality of cavities located opposite of said plurality of stitching members for respectively receiving said plurality of stitching members thereto.

* * * * *